United States Patent [19]

Ludwig

[11] 3,935,843

[45] Feb. 3, 1976

[54] NONLINEAR VACUUM SPARK ADVANCE SYSTEM

[75] Inventor: George Ludwig, Troy, Mich.

[73] Assignee: The Bendix Corporation, Southfield, Mich.

[22] Filed: Feb. 2, 1973

[21] Appl. No.: 329,289

[52] U.S. Cl. ..... 123/117 A; 137/119

[51] Int. Cl.[2] ..... F02P 5/04

[58] Field of Search ..... 123/119 A, 117 A; 137/119

[56] References Cited

UNITED STATES PATENTS

| | | | |
|---|---|---|---|
| 2,093,524 | 9/1937 | Meade | 123/117 A |
| 3,043,285 | 7/1962 | Bettoni | 123/117 A |
| 3,051,150 | 8/1962 | Johnson et al. | 123/117 A |
| 3,157,168 | 11/1964 | Sterner | 123/117 A |
| 3,356,083 | 12/1967 | Clark | 123/117 A |
| 3,804,109 | 4/1917 | Martin | 123/117 A |

*Primary Examiner*—Wendell E. Burns
*Assistant Examiner*—Ronald B. Cox
*Attorney, Agent, or Firm*—Remy Van Ophem; Bruce A. Yungman

[57] ABSTRACT

A vacuum control assembly for regulating the vacuum servo mechanism of an internal combustion engine's distributor including a vacuum sensitive device located between the carburetor spark and EGR vacuum ports and the distributor breaker plate servo mechanism, the device containing two parallel flow circuits connected to the servo, one being connected to the spark port and containing a servo operated cut-off valve, the other being connected to the EGR port and containing a servo operated switching valve that connects the distributor servo mechanism to the EGR port once the engine has reached a predetermined speed. The vacuum sensitive device provides immediate spark advance as the engine begins to accelerate by being in communication with the carburetor spark port until an operative vacuum level is reached; after the engine has accelerated to a predetermined speed the device is operative to change the spark advance signal to the continuously increasing EGR vacuum signal; a check valve is included between the servo mechanism and carburetor spark port so that during heavy accelerations the spark advance setting is quickly lowered to avoid engine detonation.

5 Claims, 2 Drawing Figures

NONLINEAR VACUUM SPARK ADVANCE SYSTEM

FIELD OF THE INVENTION

This invention relates, in general, to an engine spark timing control system. More particularly, it relates to an apparatus that provides good operating performance, fuel economy as well as reducing exhaust pollutants during high speed operation, by providing a spark advance vacuum control signal which is initially a function of carburetor spark port pressure and after a predetermined engine speed is reached switches to become a function of the EGR port vacuum.

BRIEF DESCRIPTION OF THE PRIOR ART

Most present day motor vehicles have some sort of a vacuum servo automatically controlling the advance or retard setting of the engine distributor breaker plate as a function of carburetor spark port vacuum to provide good engine performance as well as fuel economy during the different operating conditions of the engine. These vacuum servos, in their simplest form, generally consist of a housing divided into atmospheric pressure and vaccum chambers by a flexible diaphragm connected to the distributor breaker plate. The diaphragm and breaker plate are normally spring biased to the lowest advance or retard spark timing setting, and carburetor spark port vacuum normally urges the diaphragm in a spark timing advance direction upon opening of the carburetor throttle valve in an engine speed increasing direction.

With the above construction, during rapid acceleration, the drop in vacuum at the carburetor spark port permits atmospheric pressure acting on the opposite side of the servo diaphragm to immediately move the distributor breaker plate to a lower advance setting, to one that is best to meet engine performance requirements. On the other hand, however, upon return to normal operation and gradual reacceleration or deceleration of the engine, an increase in vacuum at the carburetor spark port causes an immediate return movement of the vacuum servo diaphragm to a higher engine spark timing advance setting. This provides a longer burning time for the fuel mixture before the optimum top or near top dead center position of the piston is attained, generally providing the most desirable operation. However, this longer time permits the build up to higher combustion temperatures and pressures, which are undesirable insofar as the production of oxides of nitrogen and other undesirable elements are concerned.

It will be seen, therefor, that the conventional spark timing control systems provide good performance and fuel economy, but do not necessarily minimize the output of undesirable exhaust gas elements.

Other systems are known such as the type shown in U.S. Pat No. 3,606,871 which were an improvement over the aforementioned devices. The above mentioned patent shows a mechanical device which includes a one-way check valve and an orifice in parallel flow circuits connected between the carburetor spark port and the vacuum servo mechanism. During rapid vehicle accelerations, the check valve unseats to provide a quick equalization of the pressure at the servo to the spark port vacuum, thereby lowering the spark advance setting to avoid detonation. Upon a momentary deceleration condition of operation, with a subsequent return toward its former operating condition, the orifice provides a slow build up of the vacuum level at the servo to equal that at the spark port so that the advance setting only slowly returns to normal. This results in lower peak combustion temperatures and pressures and less emission of engine pollutants. However, the above referenced system is poor for fuel economy. The slower spark advance build up due to the orifice bleed of vacuum, causes late burning and generally at a point past optimum efficiency, i.e., into the expansion cycle of the engine.

An even later patent U.S. Pat No. 3,698,366 overcame the disadvantageous function of the device above described by providing a rapid return of the spark timing advance setting to essentially its former level, after a momentary deceleration, to improve the fuel economy. This invention included a vacuum line between an intake minifold port and the distributor servo interconnected by a spring operated vacuum control valve which was in parallel flow relationship with a flow restriction in the vacuum line between the carburetor spark port and the distributor servo line.

Most automobile engines suffer degraded performance and possible increased emissions when operated at higher speeds due to a continuous reduction in the spark port vacuum signal which was heretofor provided directly to the vacuum spark advance diaphragm actuator. By connecting the spark advance diaphragm actuator to the presently available carburetor exhaust gas recirculation (EGR) vacuum port, the spark advance vacuum signal would increase proportionally with increased engine speed. None of the known prior art devices, however, are designed to carry on all of the advantageous features discussed above plus provide a distributor servo vacuum signal which is initially a function of the spark port vacuum and then after a predetermined engine speed is reached becomes a function of the EGR port vacuum.

SUMMARY OF THE INVENTION

Therefor, it is a primary object of the invention to provide an engine spark timing device that has the advantages of the conventional spark timing control system while minimizing the disadvantages by providing a nonlinear vacuum spark advance control assembly consisting of a vacuum sensitive switching mechanism connected between the carburetor spark and EGR vacuum ports and the distributor breaker plate servo mechanism. As the vehicle begins to accelerate from idle speed the distributor servo senses the carburetor spark port vacuum until a predetermined operative spark advance vacuum level is obtained; as soon as the EGR vacuum equals the predetermined operative vacuum level, this device permits the distributor servo to sense EGR spark port vacuum. Thus, improved engine performance and efficiency with a corresponding reduction in exhaust pollutants is accomplished during high speed conditions by providing a spark advance control signal which is a function of the moderate and continuously increasing EGR vacuum signal.

It is another object of this invention to provide an engine spark timing control apparatus which provides a continuously increasing vacuum control signal to the engine distributor breaker plate mechanism at high engine speed thus preventing late detonatior, resulting in better engine performance as well as reduction in the emission of exhaust pollutants.

It is another important object of this invention to provide an engine spark timing control apparatus which utilizes the presently available carburetor spark and EGR vacuum ports in order to overcome the degraded engine performance formerly caused by the exclusive use of carburetor spark port vacuum.

It is a further object of this invention to provide a vacuum control assembly for regulating a spark advance mechanism of an internal combustion engine's distributor which is responsive to air flow through the engine, and by means of a vacuum sensitive switching valve is operative to provide a vacuum control signal to the distributor which is a function of carburetor spark port vacuum or EGR port vacuum depending upon the relative engine speed.

Still another object of this invention is to provide a vacuum control assembly for regulating the vacuum servo mechanism of an internal combustion engine's distributor which includes a servo operated cut-off valve in order to prevent an excessive spark advance setting.

Another object of this invention is to provide a nonlinear vacuum spark advance system for controlling an internal combustion engine distributor breaker plate servo mechanism by including a servo operated cut-off valve between carburetor spark port and distributor which is primarily sensitive to distributor vacuum so that any vacuum leakage in the distributor circuit will be compensated by periodically reopening the cut-off valve.

It is still a further object of the present invention to provide an improved engine spark timing control apparatus which continually advances spark as the engine speed increases, and which in the event of sudden hard acceleration quickly lowers the spark advance setting to avoid engine detonation.

Other objects, features and advantages of the invention will become more apparent upon reference to the succeeding detailed description, and to the drawings illustrating a preferred embodiment thereof.

DETAILED DESCRIPTION OF THE PREFERRED EMBODIMENT

Figure 1:
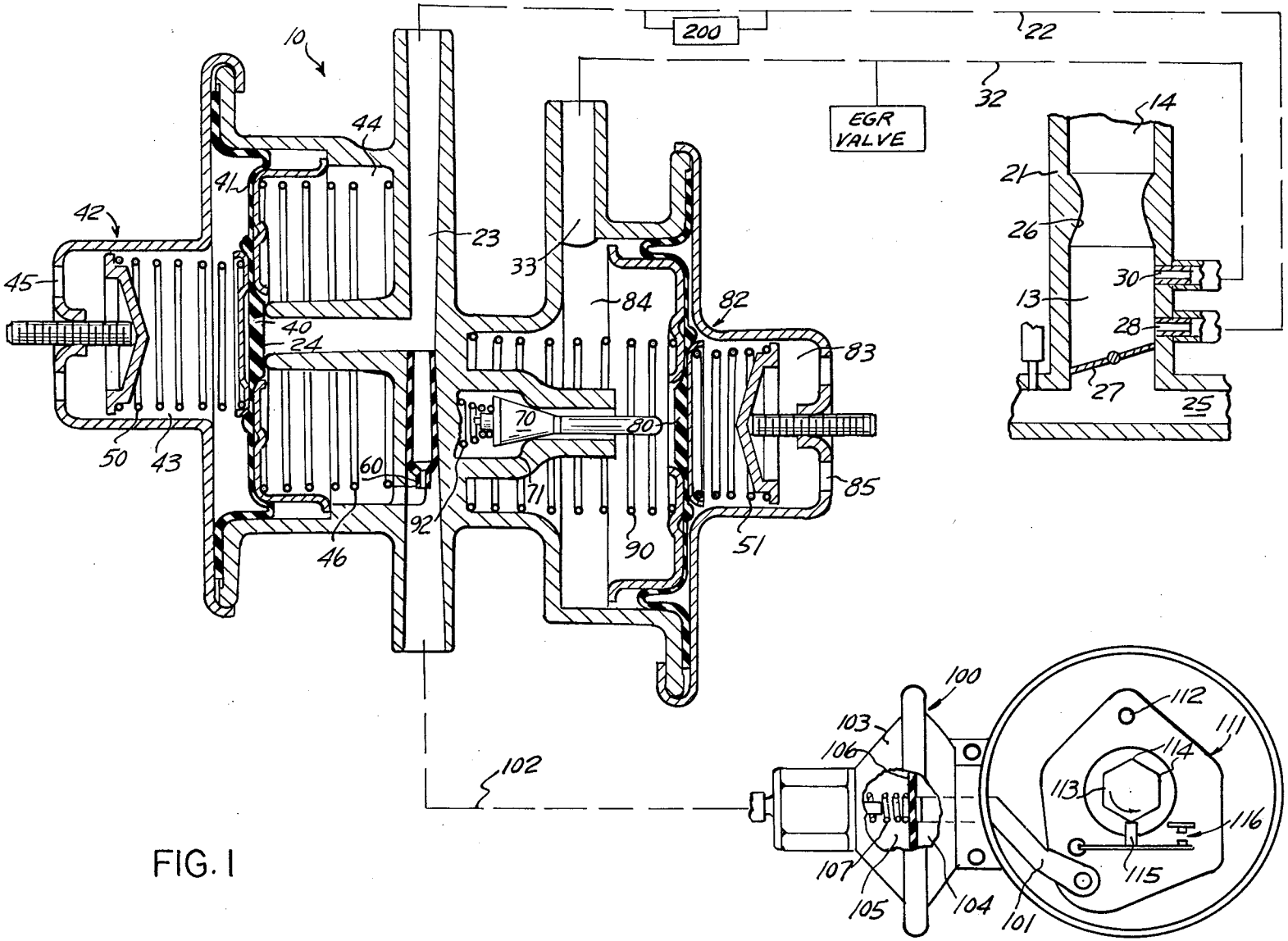
FIG. 1 schematically illustrates a partial cross-sectional view of an engine spark timing system embodying the invention.

FIG. 1 shows, schematically, only those portions of an internal combustion engine that are normally associated with the engine distributor spark timing setting control; such as, for example, a carburetor 21, a distributor breaker plate 111, and a vacuum servo 100 to control the movement of breaker plate 111. The control assembly 10 is connected to the vacuum servo 100 by means of a line 102 and to the carburetor 21 by means of the lines 22 and 32.

More specifically, carburetor 21 is shown as being of the downdraft type having the usual air-fuel induction passage 13 with an atmospheric air inlet 14 at one end and connected to the engine intake manifold 25 at the opposite end. Passage 13 contains the usual fixed area venturi 26 and a throttle valve 27. The latter is rotatably mounted on a part of the carburetor body across passage 13 in a manner to control the flow of air fuel mixture into the intake manifold. Fuel will be induced in the usual manner from a nozzle, not shown, projecting into or adjacent venturi 26 in a known manner.

Throttle valve 27 is shown in its engine idle speed position essentially closing induction passage 13, and is rotatable to a nearly vertical position essentially unblocking passage 13. A spark port 28 is provided at a point just above and in close proximity to the idle position of throttle valve 27, to be traversed by the throttle valve during its part throttle opening movements. This will change the vacuum level in spark port 28 as a function of the rotative position of the throttle valve, the spark port reflecting essentially atmospheric pressure in the air inlet 14 upon closure of the throttle valve. The vacuum sensed at spark port 28 as the throttle valve 27 opens is characterized by the curve ABE shown in FIG. 2 where vacuum is plotted against engine speed. Notice that the vacuum at the spark port increases from zero inches of mercury at engine idle speed to a Maximum M (which is determined by a myriad of engine parameters including engine size and carburetor type) and then decreases as the engine speed increases.

Figure 2:
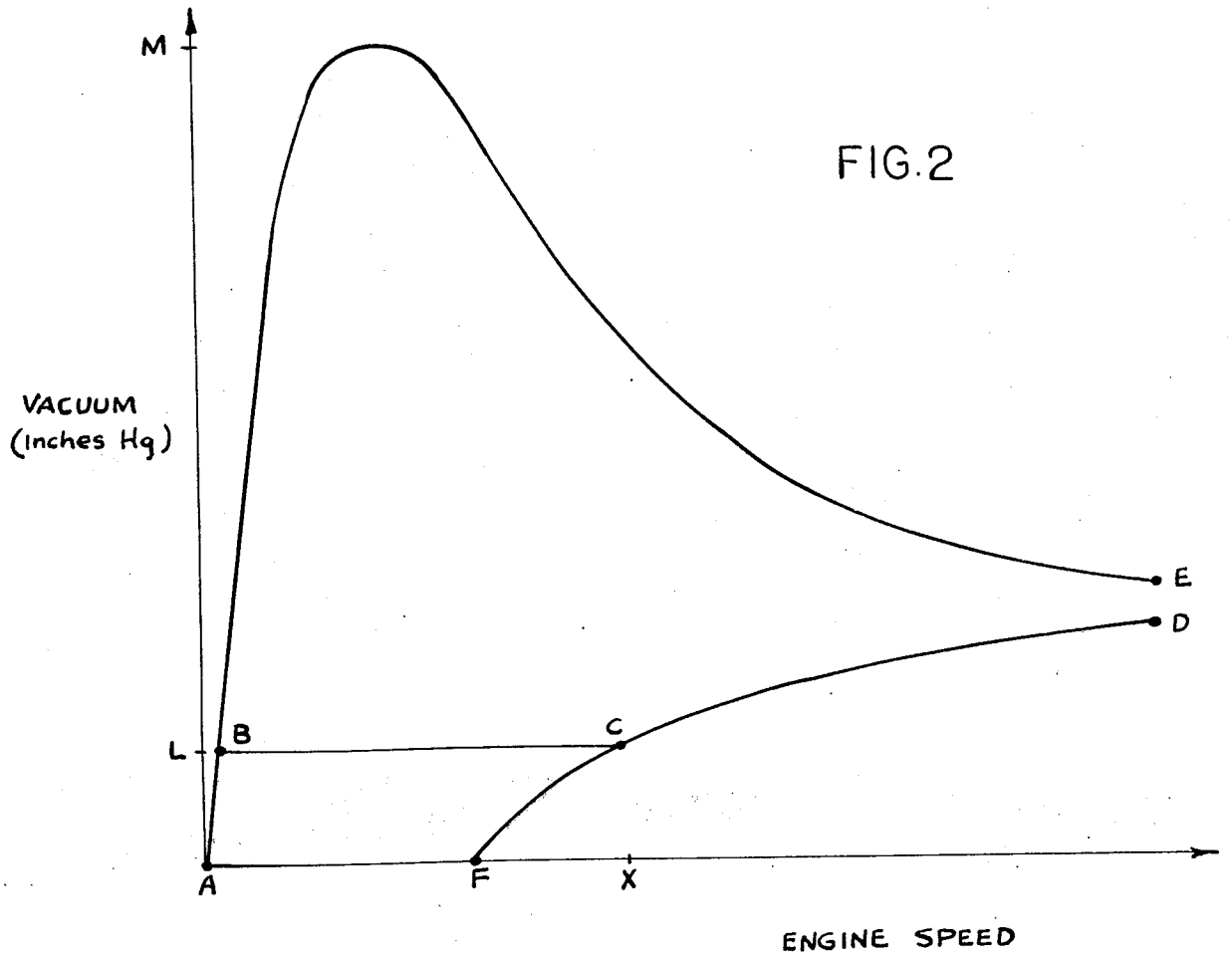
FIG. 2 graphically illustrates different operating conditions of the spark timing system shown in FIG. 1.

An exhaust gas recirculation (EGR) port 30 is provided in the inducction passage 13 of carburetor 21 between the venturi 26 and the spark port 28 a predetermined distance above the idle speed position of throttle valve 27. The vacuum sensed at EGR port 30 is characterized by the curve FCD of FIG. 2 illustrating that the vacuum increases from zero inches of mercury after the engine reaches a predetermined speed F and continuously increases proportional to the increase in engine speed. The vacuum sensed at EGR port 30 was formerly exclusively used to control the diaphragm actuator of an internal combustion engine's exhaust gas recirculation valve (not shown).

As stated previously, the distributor 110 includes a breaker plate 111 that is pivotally mounted at 112 on a stationary portion of the distributor and moveable with respect to cam 113. The latter has six peaks 114 corresponding to the number of engine cylinders. Each of the peaks cooperates with the follower 115 of a breaker point set 116 to make or break the spark connection in a known manner for each one-sixth, in this case, rotation of cam 113. Pivotal movement of breaker plate 111 in a countercockwise spark retard setting direction, or in a clockwise spark advance setting, is provided by an actuator 101 slidably extending from vacuum servo 100.

Servo 100 may be of a conventional construction. It has a hollow housing 103 whose interior is divided into an atmospheric pressure chamber 104 and a vacuum chamber 105 by an annular flexible diaphragm 106. The diaphragm is fixedly secured to actuator 101, and is biased in a rightward retard direction by compression spring 107. Chamber 104 has an atmospheric or ambient pressure vent, not shown, while the chamber 105 is connected by a bore, not shown, to line 102.

During engine-off and other operating conditions to be described, atmospheric pressure exists on both sides of the diaphragm 106, permitting spring 107 to force the actuator 101 to the lowest advance or a retard setting position. Application of vacuum to chamber 105 moves diaphragm 106 and actuator 101 toward the left to an engine spark timing advance position by degree as a function of the change in vacuum level. Since the vacuum control signal communicated to chamber 105 is of a substantially reduced magnitude for reasons to be described, the calibrated spring 107 is modified so as to be more responsive to the new vacuum control signal, i.e., EGR port vacuum.

Although only a single diaphragm servo 100 is illustrated, it will be clear that it is within the scope of the invention to connect line 102 to the primary or advance chamber of a dual diaphragm servo of the type which is commonly known in the art.

Turning now to the invention, the vacuum line 102 consists of two branches 23 and 33 in parallel flow relationship. The branch 23 is adapted to be blocked or unblocked by a servo operated cut-off valve 40. The latter is made integral with an annular flexible diaphragm 41 of a vacuum controlled servo 42. The servo is essentially conventional, and includes a hollow housing divided by the diaphragm 41 into an atmospheric or ambient pressure chamber 43, and a vacuum chamber 44. Chamber 43 is connected to atmosphere by a hole 45, while chamber 44 is connected to spark port 28 by passage 22. A spring 46 normally biases diaphragm 41 and its integral valve 40 off its seat 24.

A screw adjusted biased compensation spring 50 is disposed within chamber 43 and is operative to apply a counter spring force to the primary diaphragm spring 46. Compensation spring 50 will permit adjustment of valve 40 in order to compensate for internal component tolerances which effect the valve operating vacuum levels.

In order to compensate for any vacuum leakage which often occurs in the distributor circuit, diaphragm 41 is made primarily sensitive to distributor vacuum with only a small portion, that is the cross sectional area associated with valve seat 24, responsive to spark port pressure. Thus, if any leakage in the distributor circuit occurs valve 40 will open periodically to compensate for this vacuum leakage and then close when the desired operative vacuum level in chamber 105 of the servo 100 is attained. Also, by making diaphragm 41 primarily sensitive to distributor vacuum, the spark advance mechanism is not adversely affected by the substantial increase and then decrease in spark port vacuum as is illustrated by curve ABE of FIG. 2.

In order to prevent engine detonation when the vehicle is suddenly subject to a heavy or wide open throttle acceleration, a relatively unrestricted flow of air at atmospheric pressure is permitted to return the spark setting to the normal lower position for that particular speed and load. Check valve 60 which is disposed in passage 23 permits air at atmospheric pressure to enter chamber 44 and be applied against the major cross sectional area of diaphragm 41; thus, valve 40 quickly opens and passes the air to chamber 105. Check valve 60 is normally closed under the influence of the vacuum in passage 23 and is of the commonly known "duck-bill" type although other one-way check valves and/or flow restrictors could also be used with equal effectiveness.

Branch 33 of vacuum line 102 is adapted to be blocked or unblocked by a moveable servo operated switching valve 70. The latter is operative to be displaced from its seat 71 under the influence of an annular flexible diaphragm 80 of a vacuum controlled servo 82. The servo is essentially conventional, and includes a hollow housing divided by the diaphragm 80 into an atmospheric or ambient pressure chamber 83 and a vacuum chamber 84. Chamber 83 is connected to atmospheric by a hole 85, while chamber 84 is connected to the exhaust gas recirculation (EGR) vacuum port of carburetor 21 by passage 32. A spring 90 normally biases diaphragm 80 out of engagement with switching valve 70. Valve 70 is a normally biased closed poppet valve which is maintained into engagement with its seat 71 under the influence of a small spring 92.

A screw adjusted biased compensation spring 51 applies a counter spring force against the primary diaphragm spring 90 thus permitting adjustment of servo 82 to compensate for internal component tolerances which effect the operating vacuum levels of valve 80.

OPERATION OF THE PREFERRED EMBODIMENT

Prior to starting the engine, the distributor servo chambers 104 and 105, chambers 43 and 44 of the servo operated cut-off valve and chambers 83 and 84 of the servo operated switching valve are equalized and essentially at atmospheric pressure. Cut-off valve 40 is biased open under the influence of spring 46 and switching valve 70 is biased closed under the influence of the spring 92, diaphragm 80 biased out of engagement with valve 70 under the influence of spring 90. When the engine is started and assumes an idle speed, passages 22, 23 and 102 complete a circuit from the carburetor spark port 28 directly to the distributor servo vacuum chamber 105. An idle speed, however, throttle valve 27 is closed as shown in FIG. 1 and therefore breaker plate 111 is at its lower most spark advance or a retard setting.

As the vehicle begins to accelerate and throttle 27 opens and begins to traverse spark port 28, vacuum is applied to the distributor servo diaphragm 106 and breaker plate 111 is moved into a spark advance setting under the influence of actuator 101. As soon as an operative vacuum level is reached which is determined by the force of spring 46, diaphragm 41 will move rightward closing valve 40 against its seat 24. Should a vacuum leakage occur in the distributor vacuum circuit, valve 40 will open under the influence of spring 46 and the loss in vacuum will be quickly compensated by the spark port vacuum.

As the engine continues to accelerate and throttle valve 27 continues to open, a vacuum level is eventually created at the EGR port 30 which equals the cut-off vacuum level that closed valve 40. When this occurs diaphragm 80 moves against spring 90 into engagement with switching valve 70, thereby opening valve 70 placing EGR spark port vacuum into communication with the vacuum servo chamber 105 through passages 32, 33 and 102.

As the vehicle continues to accelerate the vacuum signal at EGR port 30 continuously increases thereby causing breaker plate 111 to continually move into a spark advance setting under the influence of diaphragm 106 and actuator 101.

When the vehicle is operating at steady state speed and is suddenly subject to a heavy or wide open throttle acceleration, the carburetor spark port vacuum drops thereby opening check valve 60. As was described above, the admission of air at atmospheric pressure to chamber 44 quickly opens valve 40 which in turn causes the spark setting to return to the normal lower position for that particular speed and load condition preventing engine detonation.

FIG. 2 represents the various operations of the invention. The curve AB illustrates the build up of vacuum at the distributor servo by means of the opening valve 40 and the vacuum applied to chamber 105 from the carburetor spark port 28. As soon as an operative vacuum level L is attained valve 40 closes and this vacuum level is continuously maintained, as illustrated by the line BC. When the engine reaches a predetermined speed F a vacuum is created at EGR port 30 and continues to increase with an increase in engine speed as illustrated by the curve FCD. When the engine reaches a speed X, the operative vacuum level L has been attained at the EGR port 30 thereby moving diaphragm 80 into engagement with poppet valve 70 opening valve 70 placing the EGR vacuum into communication with the vacuum chamber 105 of the distributor servo 100. As the vehicle continues to accelerate the spark is gradually advanced as illustrated by the curve CD.

From the above, it will be seen that the invention accomplishes all of the aforestated objects. Although only one preferred embodiment of the invention has been shown and described in detail it will be understood that changes may be made in the design and arrangement of the parts without departing from the spirit of the invention. For example, the control assembly 10 could be fabricated in two parts so that vacuum line 102 would first be in communication with the cutoff assembly 42 and then in communication the switching assembly 82. Also, a unidirectional restriction means 200 (commonly known in the art) could be placed in flow-circuit relationship with vacuum line 22 insuring a gradual spark advance and a rapid spark retard.

I claim:

1. A vacuum control valve assembly for regulating the vacuum servo mechanism of an internal combustion engine distributor comprising:

a housing having a first annular cavity with one open end and an opposite closed end, said housing further having a second annular cavity with an open end and an opposite closed end adjacent said first cavity opposite closed end, said first and second cavities having at least one port for fluid communication into or out of said cavities;

a central passage interposed between the closed end of said first cavity and the closed end of said second cavity, said central passage having an inlet adapted to receive a first vacuum source signal and an outlet adapted to provide an outlet signal to said vacuum servo of the distributor;

a first cover member mounted to the open end of said first cavity, a first annular cup shaped member mounted within said first cavity of the housing, between said first cover member and said opposite closed end of the first cavity;

a first annular diaphragm having an outside diameter portion interposed between said first cover member and said open end of said first cavity and an inside diameter portion adapted to engage said first annular member, said first annular diaphragm sealingly defining a first and second chamber within the first cavity of the housing;

a first conduit disposed within said first cavity, said conduit having one end portion extending into said first cavity through said opposite closed end of the cavity, said conduit further having an opposite end portion integral with said opposite closed end of the first cavity, and a first passage providing communication between said central passage and said first chamber of the first cavity, said one end portion of said first conduit having a valve seat;

a check valve disposed within said central passage between said first passage of the first conduit and said central passage outlet, said check valve adapted to permit fluid communication through said central passage only when said first vacuum source signal is below a predetermined level;

first means for biasing said first diaphragm, said first biasing means including:

first means for providing and regulating communication between said second chamber of the first cavity and the atmosphere; and means for limiting fluid communication from said central passage to said first chamber of the first cavity when said first vacuum source signal is above a predetermined level;

a second cover member mounted to the open end of said second cavity;

a second annular cup shaped member mounted within the second cavity of said housing, between said second cover member and said opposite closed end of said second cavity;

a second annular diaphragm having an outside diameter portion interposed between said second cover member and said open end of said second cavity and an inside diameter portion adapted to engage said second annular member, said second annular diaphragm sealingly defining a first and second chamber within said second cavity of the housing;

means for sealing said first cover member to said open end of the first cavity and said second cover member to said open end of the second cavity of the housing;

a second conduit disposed within said second cavity, said conduit having one end portion extending into said first cavity through said opposite closed end of the second cavity, said second conduit further having an opposite end portion integral with the opposite closed end of said second cavity, a second passage providing fluid communication from said first chamber of the second cavity to said central passage outlet and means for terminating the fluid communication from said first chamber of the second cavity of said central passage outlet;

a third conduit having one end portion extending out of said second cavity and an opposite end portion integral with said second cavity, said conduit having a third passage for providing communication from a second signal source to said first chamber of the second cavity of the housing;

second means for biasing said second diaphragm, said second biasing means including:

second means for providing and regulating communication between said second chamber of said second cavity and the atmosphere; and means for controlling fluid communication from said first chamber of the second cavity to said central passage outlet when the signal source of said second vacuum source signal in the first chamber of the second cavity is above said predetermined level;

an outlet port integral with the opposite closed end of said first cavity of the housing, said outlet port having a passage adapted to provide fluid communication from the first chamber of said first cavity to said central passage outlet.

2. The control valve assembly, as recited in claim 1 wherein the first means for providing and regulating communication between said second chamber of the first cavity and the atmosphere further includes:

a first compression spring mounted between said first annular cup shaped member and said opposite closed end of the first cavity;

a second compression spring coaxially mounted adjacent said first annular diaphragm and said first cover member;

means for adjusting said first and second compression springs, said adjusting means mounted coaxially with said second compression spring; and means for maintaining said second chamber of the first cavity at atmospheric pressure.

3. The control valve assembly, as recited in claim 1 wherein the means for limiting fluid communication further includes:

a valve body integral with said first annular diaphragm, said valve body adapted to communicate with said valve seat in the one end portion of said first conduit; and an aperture in the first annular cup shaped member adapted to receive said valve body.

4. The control valve assembly, as recited in claim 1, wherein the means for terminating fluid communication from said first chamber of the second cavity to said control passage outlet further comprises:

a second annular valve seat disposed within said second passage;

a piston member disposed within said second passage, said piston member having one end portion extendable into said first chamber of said second cavity and an opposite end portion for engagement with said second valve seat disposed in said second passage; and third means for biasing said opposite end portion of said piston member into engagement with said second valve seat.

5. The control valve assembly, as recited in claim 1, wherein the second means for providing and regulating communication between said second chamber of the second cavity and the atmosphere further comprises:

means for maintaining said second chamber of the first cavity at atmospheric pressure;

a third compression spring mounted between said second annular cup shaped member and said opposite closed end of the second cavity;

a fourth compression spring coaxially mounted adjacent said second annular diaphragm and said second cover member; and means for adjusting said third and fourth compression springs, said adjusting means mounted coaxially with said fourth compression spring.

* * * * *